US007270075B1

(12) United States Patent
Jones

(10) Patent No.: US 7,270,075 B1
(45) Date of Patent: Sep. 18, 2007

(54) COMBINATION STORAGE COVER AND CRUISING TOP FOR A BOAT

(76) Inventor: Bruce K. Jones, 6935 Limerick Dr., Onsted, MI (US) 49265

( * ) Notice: Subject to any disclaimer, the term of this patent is extended or adjusted under 35 U.S.C. 154(b) by 0 days.

(21) Appl. No.: 11/245,931

(22) Filed: Oct. 7, 2005

(51) Int. Cl.
*B63B 17/02* (2006.01)
*B63B 17/00* (2006.01)

(52) U.S. Cl. ..... 114/361; 114/364

(58) Field of Classification Search ..... None
See application file for complete search history.

(56) References Cited

U.S. PATENT DOCUMENTS

| | | | | |
|---|---|---|---|---|
| 739,389 | A | 9/1903 | Castle | |
| 869,399 | A | 10/1907 | Walter | |
| 2,280,729 | A | 4/1942 | Sutton | |
| 3,165,111 | A | 1/1965 | Foster | |
| 3,434,166 | A | 3/1969 | Clymer | |
| 3,773,379 | A | 11/1973 | Loiseau | |
| 3,955,228 | A | 5/1976 | Gaschenko et al. | |
| 4,082,347 | A * | 4/1978 | Petretti | 296/98 |
| 4,582,016 | A | 4/1986 | Hansen | |
| 4,659,136 | A * | 4/1987 | Martin et al. | 296/100.04 |
| 4,828,317 | A * | 5/1989 | Muscat | 296/122 |
| 5,016,558 | A | 5/1991 | Oehler | |
| 5,044,298 | A | 9/1991 | Pepper et al. | |
| 5,706,752 | A * | 1/1998 | Menne et al. | 114/361 |
| 6,006,692 | A | 12/1999 | Szukhent, Jr. | |
| 6,158,377 | A | 12/2000 | Szukhent, Jr. | |
| 6,209,477 | B1 | 4/2001 | Biedenweg | |
| 6,349,666 | B1 | 2/2002 | Hastings | |
| 6,666,163 | B2 | 12/2003 | Pastor et al. | |
| 6,799,529 | B1 | 10/2004 | Willis | |
| 2003/0075097 | A1 | 4/2003 | Warfel et al. | |
| 2003/0127036 | A1 | 7/2003 | Pastor et al. | |
| 2003/0217683 | A1 | 11/2003 | Heckman | |
| 2004/0134408 | A1 | 7/2004 | Warfel et al. | |

* cited by examiner

*Primary Examiner*—Lars A. Olson
*Assistant Examiner*—Daniel V. Venne
(74) *Attorney, Agent, or Firm*—Young Basile

(57) ABSTRACT

The specification discloses a combination cruising top and storage cover for a boat of the kind having a deck disposed between fore and aft ends of the boat, the deck including a passenger area, the combination cruising top and storage cover comprising at least first and second cover portions selectively pivotally moveable towards each other and into a first, raised configuration, wherein the at least first and second cover portions are arranged vertically adjacent each other in generally lapped relation to define a cruising top for a boat, and selectively pivotally moveable away from each other and into a second, lowered configuration, wherein the at least first and second cover portions are each positioned vertically lower than in the first, raised configuration and arranged generally horizontally in substantially end-to-end relation to thereby define a storage cover for covering at least a portion of a boat's deck.

18 Claims, 6 Drawing Sheets

COMBINATION STORAGE COVER AND CRUISING TOP FOR A BOAT

CROSS-REFERENCE TO RELATED APPLICATIONS

Not applicable.

STATEMENT REGARDING FEDERALLY SPONSORED RESEARCH OR DEVELOPMENT

Not applicable.

INCORPORATION BY REFERENCE OF MATERIAL SUBMITTED ON A COMPACT DISC

Not applicable.

FIELD OF THE INVENTION

The present invention pertains generally to the field of storage covers and cruising tops for boats, including, for example, pontoon boats, and more particularly to the field of combination storage covers and cruising tops for boats.

BACKGROUND OF THE INVENTION

The act of covering boats for storage, including, for instance, pontoon boats which typically comprise a large open deck substantially comprised of a passenger area, can be a laborious endeavor requiring several persons.

Previously, efforts have been made to address this problem, including, in one form, by the provision of cruising tops (i.e., tops for covering all or a part of the passenger area during use of the boat) which may be selectively converted to storage covers. Exemplary in these regards is the disclosure of Heckman, U.S. Published Patent Application No. US2003/0217683 A1. Heckman more particularly discloses a boat cover lift which provides for the pneumatic movement of a one-piece boat top of fixed length between a raised position, wherein the boat top serves as a cruising cover above the boat deck, and a lowered position, wherein the boat top serves to cover the immediately underlying deck for storage.

But while the foregoing disclosure teaches a selectively convertible boat top and cover, neither it nor the prior art generally represents an entirely satisfactory solution. Accordingly, there continues to exist the need for a boat cover which serves as both a cruising top and a storage cover, and which may be selectively converted between both configurations.

BRIEF SUMMARY

The specification addresses the foregoing needs, and presents other objects and advantages, through the provision of a combination cruising top and storage cover for use in conjunction with a boat of the kind having a deck disposed between fore and aft ends of the boat, the deck including a passenger area.

The inventive combination cruising top and storage cover comprises at least first and second cover portions selectively positionable between a first, raised configuration, wherein the at least first and second cover portions are arranged vertically adjacent each other in generally lapped relation to define a cruising top for a boat, and a second, lowered configuration, wherein the at least first and second cover portions are each positioned vertically lower than in the first, raised configuration and arranged generally horizontally adjacent each other in end-to-end relation to thereby define a storage cover for covering at least a portion of a boat's deck.

In one embodiment of the present invention, the at least first and second cover portions define, in the second, lowered configuration thereof, a storage cover for substantially the entire passenger area of a boat's deck between the fore and aft ends thereof.

According to one feature of the instant invention, the at least first and second cover portions are each pivotally moveable in relation to each other, with the at least first and second cover portions being pivotally moveable into each of the first, raised and second, lowered configurations thereof.

Per another feature hereof, the at least first and second cover portions each comprise a covered framework. This framework may comprise, in one aspect of the present invention, at least two pair of lateral struts, each pair of struts pivotally mountable at one end thereof to a boat and at the other end thereof pivotally connected to one of a pair of laterally spaced-apart, horizontally extending frame members interconnected by a plurality of spaced-apart, transverse frame members.

According to yet another aspect of this invention, the at least first and second cover portions each comprise a framework covered by a covering material which extends between the at least first and second cover portions to define a continuous storage cover when the at least first and second frame portions are in the second, lowered configuration thereof.

Per still another feature hereof, means may be provided for effecting the powered movement of each of the at least first and second cover portions between the first, raised and second, lowered configurations thereof.

BRIEF DESCRIPTION OF THE DRAWINGS

These and other features of the instant invention will be better understood with reference to the following description and accompanying drawings, of which.

WRITTEN DESCRIPTION

Figure 1A:
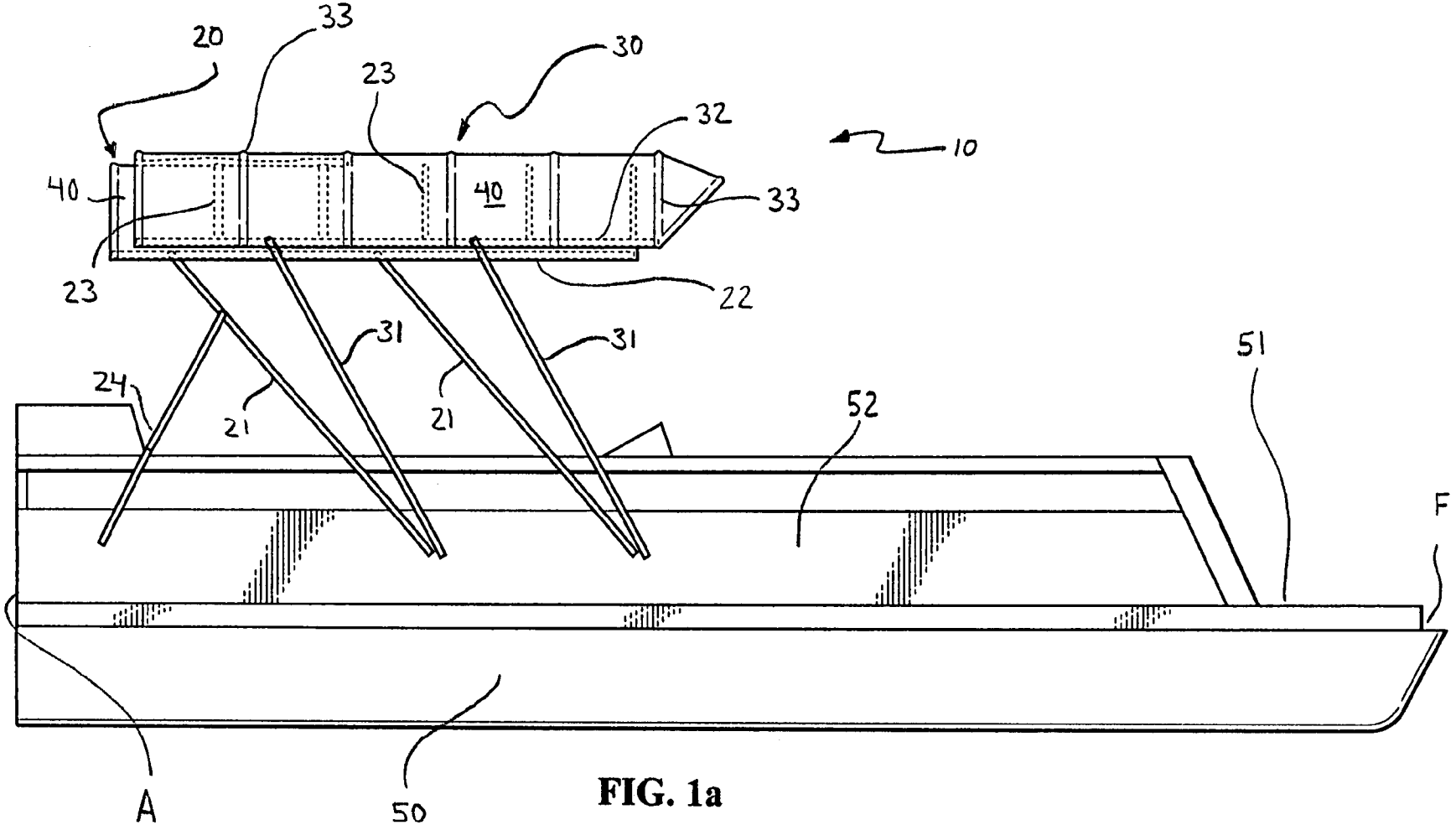
FIGS. 1*a* through 1*c* comprise lateral elevations showing, in sequence, the combination storage cover/cruising top of the present invention in the first, raised configuration thereof (FIG. 1*a*), wherein the same defines a Bimini-style cruising top, in the second, lowered configuration thereof (FIG. 1*c*), wherein the same defines a storage cover, and in the process of conversion between these raised and lowered configurations (FIG. 1*b*)

Referring now to the drawings, wherein like numerals refer to like or corresponding parts throughout the several views, the present invention may be seen to most generally comprise a combination cruising top and storage cover 10 for use in combination with a boat 50, such as, by way of non-limiting example, the illustrated pontoon boat, the boat being of the kind having a deck 51 disposed between fore F and aft A ends thereof, the deck having a passenger area (defined, in the exemplary boat, by the enclosure 52) comprising all or a portion of the deck 51. The combination cruising top and storage cover 10 itself comprises, more particularly, at least first 20 and second 30 cover portions selectively positionable between a first, raised configuration (FIG. 1*a*, FIG. 3), wherein the at least first 20 and second 30 cover portions are arranged vertically adjacent each other in generally lapped relation to define a cruising top for the boat 50, and a second, lowered configuration (FIG. 1*c*, FIG. 4), wherein the at least first 20 and second 30 cover portions are each positioned vertically lower than in the first, raised configuration and are further arranged generally horizontally adjacent each other in end-to-end relation to thereby define a storage cover for covering at least a portion of the boat's deck 51.

While, in the illustrated embodiment, the first 20 and second 30 cover portions are shown as being of sufficient dimensions so that, in second, lowered configuration thereof, they together define a storage cover for substantially the entire passenger area 52 of a boat's deck 51, it will be understood that these dimensions may be varied according to the size of the area for which a storage cover is desired. Accordingly, it is contemplated that the cover portions 20, 30 may be of dimensions sufficient to define a storage cover for the entire length of a boat's deck 51 between the fore F and aft A ends thereof, or for some length less than that, including, by way of non-limiting example, just the cockpit area.

Figure 2:
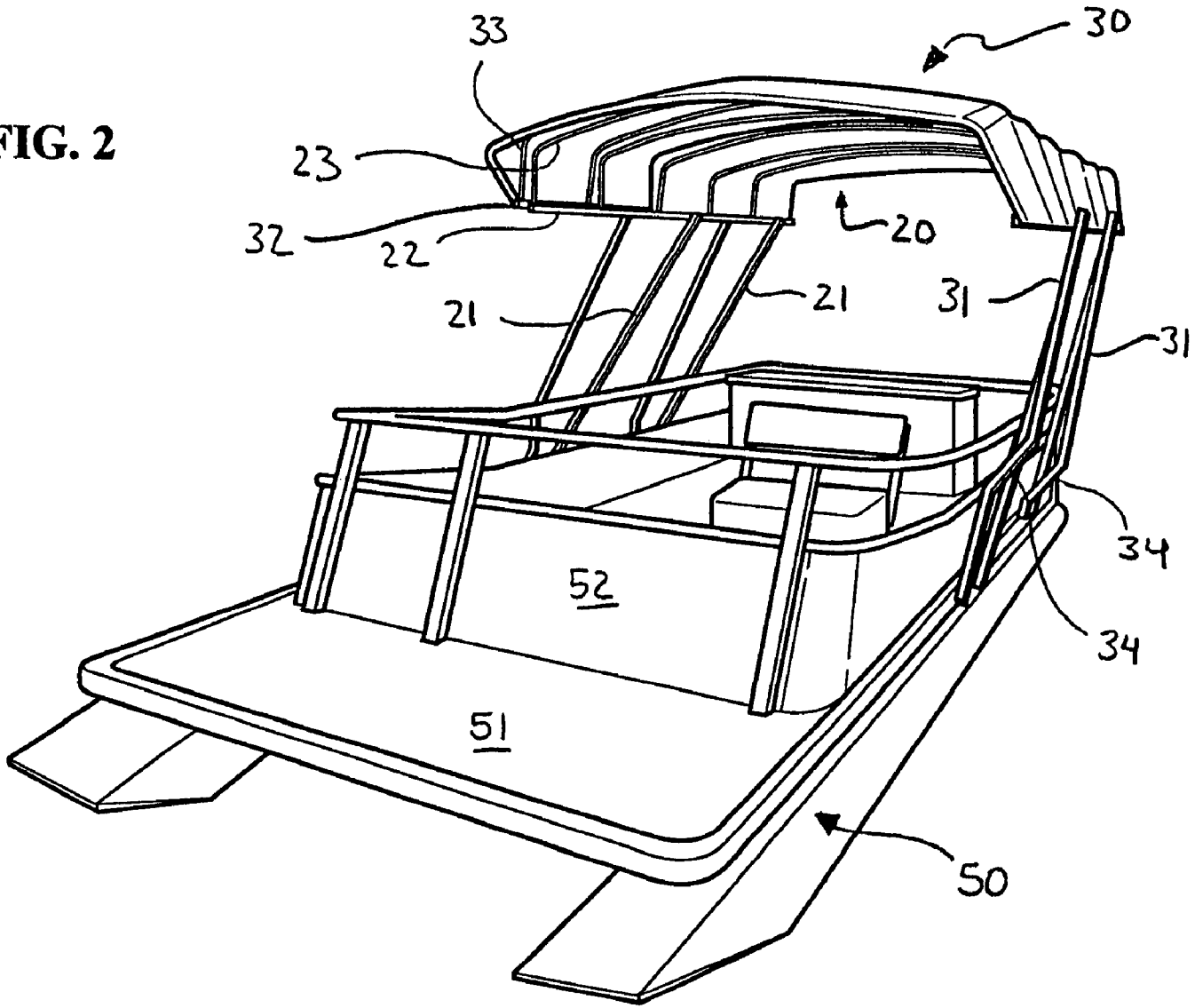
FIG. 2 is a quartering perspective view of the inventive combination storage cover/cruising top in the first, raised configuration thereof.
Figure 3:
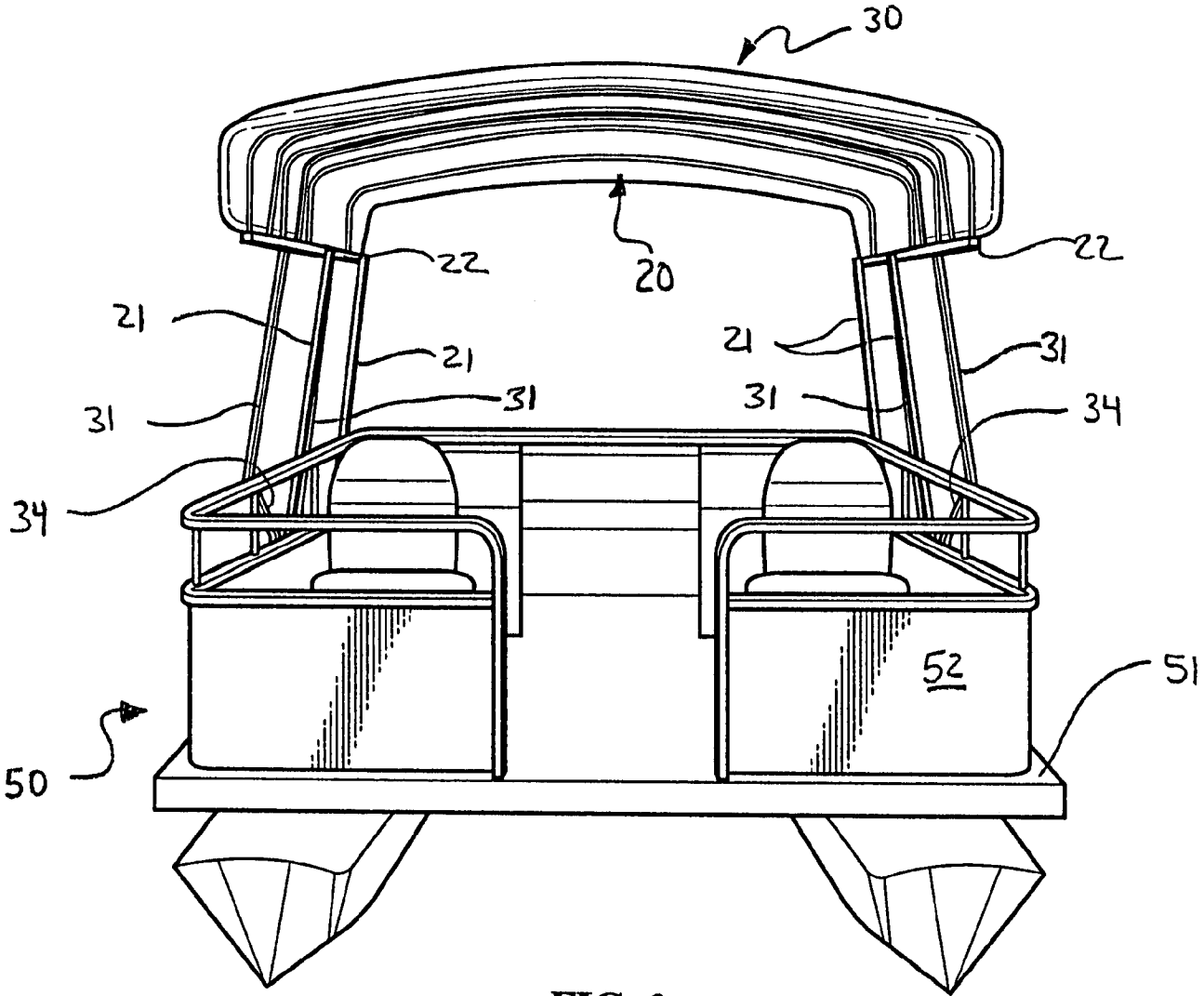
FIG. 3 is a frontal elevation showing the inventive combination storage cover/cruising top in the first, raised configuration thereof, wherein the same defines a cruising top.
Figure 4:
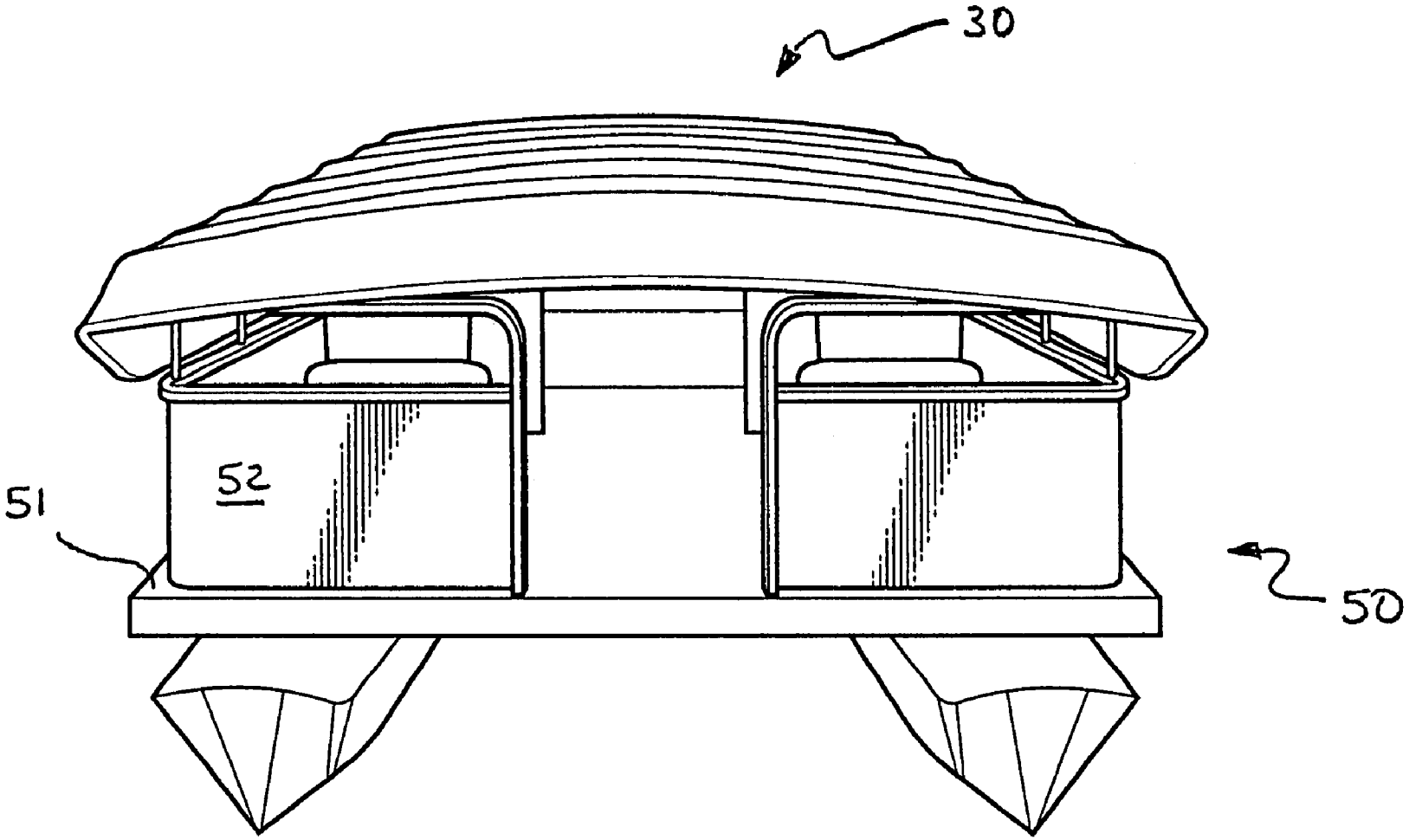
FIG. 4 is a frontal elevation showing the inventive combination storage cover/cruising top in the second, lowered configuration thereof, wherein the same defines a storage cover.

With reference also being had to FIGS. 2 through 4, each of the at least first 20 and second 30 cover portions will be seen to comprise, according to the illustrated embodiment, a covered framework. This covered framework may, per the exemplary form of the present invention, comprise a plurality of struts 21 and 31, respectively, with a pair of such struts 21, 31 disposed laterally in each of the at least first 20 and second 30 cover portions and each such strut 21, 31 pivotally connected at a lower end to the boat 50, and further pivotally connected at an opposite, upper end to one of a pair of laterally spaced-apart, horizontally extending frame members 22 and 32, respectively. Frame members 22, 32 are, in turn, interconnected by a plurality of spaced-apart, transverse frame members 23 and 33, respectively.

As shown best in FIGS. 2 and 3, each of the struts 21 of the first cover portion 20 is pivotally connected to an inside surface of one or the other of the horizontally extending frame members 22, while each of the struts 31 of the second cover portion 30 is pivotally secured to an outside surface of one or the other of the horizontally extending frame members 32, this arrangement facilitating the nesting disposition of the first 20 and second 30 cover portions of the exemplary embodiment in the first, raised configuration thereof (FIG. 1*a*).

Transverse frame members 23, 33 may, as shown, be characterized by a generally inverted U-shape, thus imparting greater height to the cruising top defined by the at least first 20 and second 30 cover portions in the first, raised configuration thereof. However, it is also envisioned that the framework may be comprised of transverse frame members 23, 33 of different configurations, or that the framework so described may be constructed altogether differently. Furthermore, it is contemplated that each of the cover portions 20 and 30 need not comprise frameworks at all, but may, by way of non-limiting example, instead each comprise monolithic covers fashioned from plastic or the like, the only limitation being the requirement of providing at least first 20 and second 30 cover portions selectively positionable between a first, raised configuration, wherein the at least first 20 and second 30 cover portions are arranged vertically adjacent each other in generally lapped relation to define a cruising top for a boat (e.g., 50), and a second, lowered configuration, wherein the at least first 20 and second 30 cover portions are each positioned vertically lower than in the first, raised configuration and arranged horizontally adjacent each other in end-to-end relation to thereby define a storage cover for covering at least a portion of a boat's deck (e.g., 51).

Pivotal connection between the struts 21 and 31 and the boat 50 and each of the horizontally extending frame members 22 and 32 may be accomplished in any conventional fashion, as known to those skilled in the art. Thus, for example, pivot pins (not depicted) may interconnect each of the struts 21 and 31 to the boat as well as to each of the frame members 22 and 32.

The several constituent elements comprising the frameworks of each of the at least first 20 and second 30 cover portions as described herein may be formed of any suitably strong material, including, by way of non-limiting example, wood, metal, composite, etc. In the illustrated embodiment, each such framework is formed from aluminum tubing.

As best depicted in FIG. 1*a*, the second cover portion 30 is characterized by greater lateral dimensions than the first cover portion 20, such that, in the first, raised configuration thereof, the first cover portion 20 may be nested beneath the second cover portion 30 in generally lapped relation.

With particular reference to FIG. 2, it can be seen that each of the struts 31 of the second cover portion 31 is characterized by an outwardly angled section 34 along the principal length thereof subsequent to the point of pivotal securement to the boat 50, the angular degree and length of this section 34 being sufficient to increase the distance between the upper ends of the struts 31 disposed laterally oppositely so as to permit their pivotal connection to the horizontally extending frame members 32 of the laterally wider second cover portion 30.

Figure 1B:
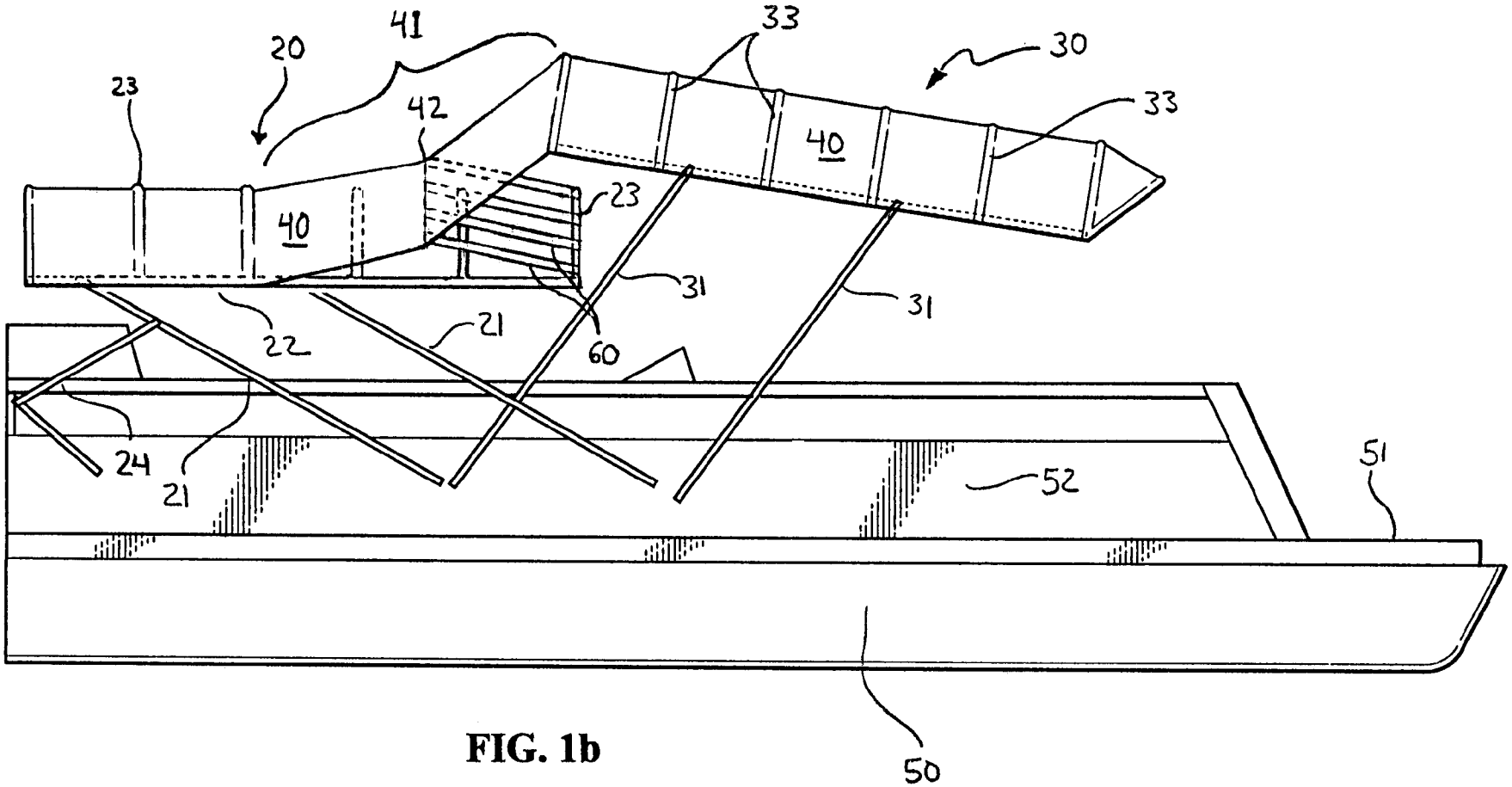
Figure 1C:
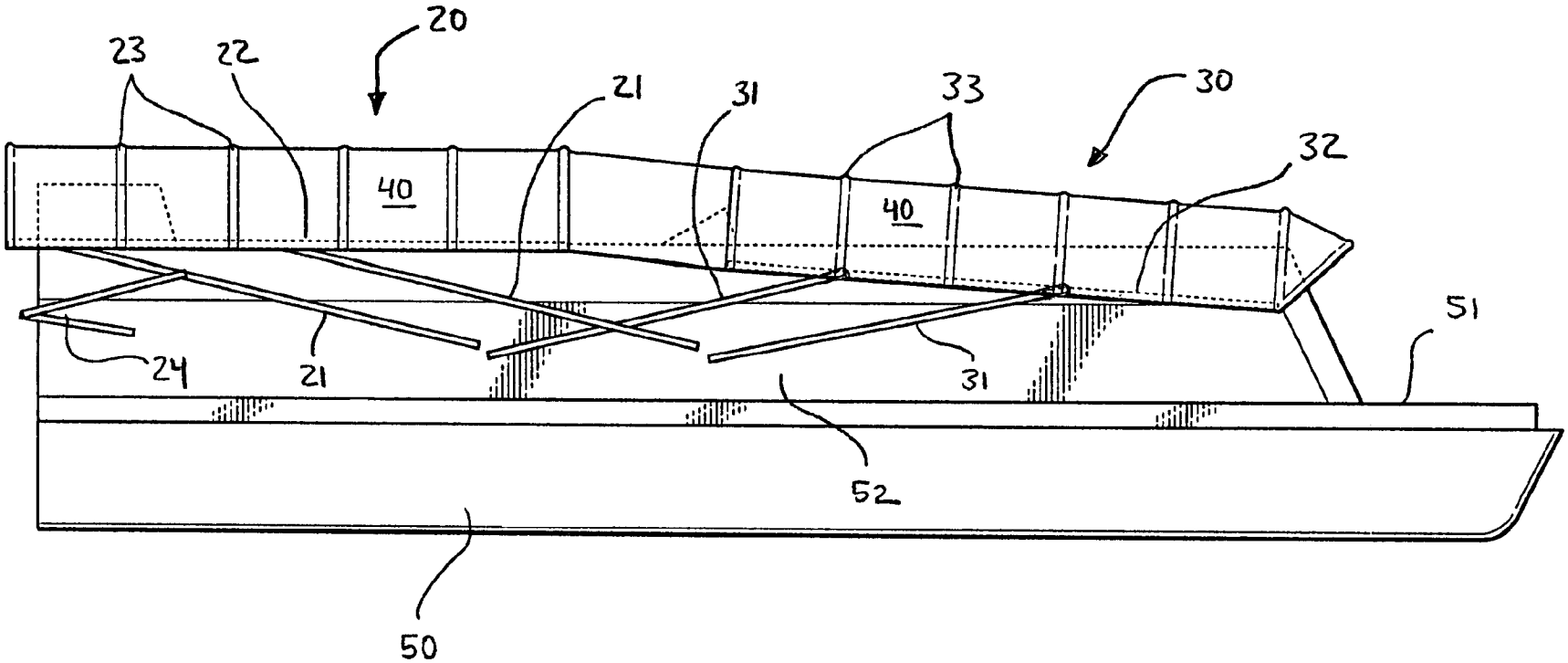

As indicated previously, the at least first 20 and second 30 cover portions comprise, according to the illustrated embodiment, a covered framework. Further thereto, the framework of each of the first 20 and second 30 cover portions is covered by a covering material 40 which may take the form of canvas, nylon, or any other material suited to such application. According to the illustrated embodiment, and as best shown in FIGS. 1*a* through 1*c*, the covering material 40 extends between the framework of each of the at least first 20 and second 30 cover portions to define a continuous storage cover when the at least first 20 and second 30 cover portions are in the second, lowered configuration thereof. However, it is contemplated that each of the at least first 20 and second 30 cover portions may be separately covered so as to constitute discrete cover portions.

In the illustrated embodiment of the invention, wherein the covering material 40 extends between the at least first 20 and second 30 cover portions, it is necessary, in order to permit the movement of the first 20 and second 30 cover portions into the first, raised configuration thereof (FIG. 1*a*), either that the covering material 40 covering the first cover portion 20 be moveable in relation thereto so as to be drawn rearwardly over the first cover portion 20 (as shown in FIGS. 1*a* and 1*b*), or that there be provided a sufficient length of covering material 40 between the first 20 and second 30 cover portions to similarly permit the second cover portion 30 to be drawn over top of the first cover portion 20 and into the vertically adjacent, generally lapped relation of the raised configuration. In the illustrated form of the present invention, movement of the first 20 and second 30 cover portions into the first, raised configuration thereof (FIG. 1*a*) from the second, lowered configuration is accommodated by fixing the covering material 40 to only the three transverse frame members 23 proximate the aft end A of the boat 50, as shown best in FIG. 1*b*, such that a portion 41 of the covering material 40 is moveable relative to the remaining transverse frame members 23.

Further according to the illustrated embodiment, and with continuing reference to FIG. 1*b*, it is desirable to control the folding of that portion 41 of the covering material 40 which is moveable in relation to the first cover portion 20, particularly in order to ensure that the at least first 20 and second 30 cover portions are properly seated relative to each other in the raised configuration thereof. To this end, there is provided in the illustrated form of the present invention means for controllably folding the covering material 40, which means comprise one or more elastic members, such as the illustrated elastic straps 60 (shown only in FIG. 1*b*), each fixed at a first end thereof to the transverse frame member 23 at the foreward-most end of the first cover portion 20, and at a second, opposite end to the covering material 40 along a transverse seam or crease 42 defined at approximately the longitudinal mid-point of the moveable portion of the covering material. These one or more elastic straps 60 are biased so as to urge the moveable portion 41 of the covering material 40 toward the transverse frame member 23 to which the straps 60 are fixed, thus ensuring that the moveable portion 41 folds along the seam or crease 42 as the second cover portion 30 moves into position relative to the first cover portion 20 to define the raised configuration thereof.

Pivotal movement of the at least first 20 and second 30 cover portions between the first, raised (FIG. 1*a*) and second, lowered (FIG. 1*c*) configurations thereof may be accomplished manually, by, in the illustrated form of this invention, the simple expedient of grasping the struts 21 and 31 to urge the cover portions into position. Of course, other manually-operated, mechanical means may be incorporated into the present invention, including, by way of example and without limitation: A manually powered winch or winches (not shown) operatively coupled, such as by pulleys, to the first and second frame portions by ropes, cables, or the like, and the operation of which would serve to raise or lower the frame portions; gas pistons or the like (not shown) connected to the struts 21 and 31 and the boat and operative to assist manual movement of the frame portions between the first, raised and second, lowered configurations thereof. Alternatively, it is contemplated that the invention may further comprise means for effecting the powered movement of each of the at least first 20 and second 30 cover portions between the raised and lowered configurations thereof. Such powered means may, per the exemplary form of the present invention, comprise one or more centrally actuated hydraulic pistons (not depicted) of conventional construction secured to the boat 50 and one or more struts 21 and 31 and operative to mechanically urge these struts, and hence the entirety of the cover portions 20, 30, between the raised and lowered configurations thereof. Alternatively, and without limitation, such powered means may comprise motor-driven gears (not shown) operatively connected to the struts 21 and 31 and operative to mechanically urge the cover portions 20, 30 between the raised and lowered configurations thereof.

Numerous means known to those skilled in the art, and the employment of which in conjunction with the present invention will be appreciated with reference to this specification, may be provided to secure the first 20 and second 30 cover portions in the first, raised configuration thereof. Referring to FIGS. 1*a* through 1*c*, one such means is depicted to comprise at least a first support strut 24 pivotally connected at one end thereof to the boat 50 and at the other end thereof to a strut 21 of the first cover portion 20 framework. The at least first support strut 24 will be seen from FIGS. 1*a* through 1*c* to comprise at least first and second sections articulated so as to fold toward each other at the point of articulation upon transitioning of the first 20 and second 30 cover portions from the first, raised configuration to the second, lowered configuration. Oppositely, when the at least first 20 and second 30 cover portions move into the first, raised configuration thereof, it will be seen from the sequence of drawings that the first and second sections of the at least first support strut 24 are unfolded away from each other at the point of articulation to define, in the first, raised configuration of the first 20 and second 30 cover portions, a generally linear load-bearing support.

It will be appreciated that the invention as herein disclosed provides a combination storage cover and cruising top for a boat which is at once easy to employ, inexpensive to manufacture, and which serves to overcome the disadvantages attending prior art devices of this type.

Of course, the foregoing is merely illustrative of the present invention, and those of ordinary skill in the art will appreciate that many additions and modifications to the present invention, as set out in this disclosure, are possible without departing from the spirit and broader aspects of this invention as defined in the appended claims.

The invention in which an exclusive property or privilege is claimed is defined as follows:

1. A combination cruising top and storage cover for a boat of the kind having a deck disposed between fore and aft ends of the boat, the deck including a passenger area, the combination cruising top and storage cover comprising:

at least first and second covered frameworks selectively positionable between a first, raised configuration, wherein the at least first and second covered frameworks are arranged vertically adjacent each other in generally lapped relation to define a cruising top for a boat, and a second, lowered configuration, wherein the at least first and second covered frameworks are each positioned vertically lower than in the first, raised configuration and arranged generally horizontally in substantially end-to-end relation to thereby define a storage cover for covering at least a portion of a boat's deck.

2. The combination cruising top and storage cover of claim 1, wherein the at least first and second covered frameworks are each pivotally moveable in relation to each other, and wherein further each of the at least first and second covered frameworks is pivotally moveable into each of the first, raised and second, lowered configurations thereof.

3. The combination cruising top and storage cover of claim 1, wherein each of the at least first and second covered frameworks comprises a framework including at least two pair of lateral struts, each pair of struts pivotally mountable at one end thereof to a boat and at the other end thereof pivotally connected to one of a pair of laterally spaced-apart, generally horizontally extending frame members interconnected by a plurality of spaced-apart, transverse frame members.

4. The combination cruising top and storage cover of claim 1, wherein the at least first and second covered frameworks each comprise a framework covered by a covering material which extends between the at least first and second cover portions to define a continuous storage cover when the at least first and second frame portions are in the second, lowered configuration thereof.

5. The combination cruising top and storage cover of claim 4, further comprising means for effecting the powered movement of each of the at least first and second covered frame portions between the first, raised and second, lowered configurations thereof.

6. The combination cruising top and storage cover of claim 1, further comprising means for effecting the powered movement of each of the at least first and second covered frameworks between the first, raised and second, lowered configurations thereof.

7. The combination cruising top and storage cover of claim 1, wherein in the second, lowered configuration thereof, the at least first and second covered frameworks define a storage cover for substantially the entire passenger area of a boat's deck between the fore and aft ends thereof.

8. A combination cruising top and storage cover for a boat of the kind having a deck disposed between fore and aft ends of the boat, the deck having a passenger area, the combination cruising top and storage cover comprising:

at least first and second frame portions mountable to a boat for pivotal movement in relation thereto, the at least first and second frame portions supporting a covering material extending continuously therebetween; and the at least first and second covered frame portions each being selectively pivotally moveable towards each other and into a first, raised configuration, wherein the at least first and second covered frame portions are arranged vertically adjacent each other in generally lapped relation to define a cruising top for a boat, and selectively pivotally moveable away from each other and into a second, lowered configuration, wherein each of the at least first and second covered frame portions is positioned vertically lower than in the first, raised configuration and arranged generally horizontally adjacent each other to thereby define an unitary storage cover for covering at least a portion of a boat's deck.

9. The combination cruising top and storage cover of claim 8, wherein each of the at least first and second covered frame portions comprises a framework including at least two pair of lateral struts, each pair of struts pivotally mountable at one end thereof to a boat and at the other end thereof pivotally connected to one of a pair of laterally spaced-apart, generally horizontally extending frame members interconnected by a plurality of spaced-apart, transverse frame members.

10. The combination cruising top and storage cover of claim 8, wherein in the second, lowered configuration thereof, the at least first and second covered frame portions define a storage cover for substantially the entire passenger area of a boat's deck between the fore and aft ends thereof.

11. A combination cruising top and storage cover for a boat of the kind having a deck disposed between fore and aft ends of the boat, the deck including a passenger area, the combination cruising top and storage cover comprising:

at least first and second cover portions each being selectively pivotally moveable towards each other and into a first, raised configuration, wherein the at least first and second cover portions are arranged vertically adjacent each other in generally lapped relation to define a cruising top for a boat, and selectively pivotally moveable away from each other and into a second, lowered configuration, wherein each of the at least first and second cover portions is positioned vertically lower than in the first, raised configuration and wherein the at least first and second cover portions are arranged generally horizontally in substantially end-to-end relation to thereby define a storage cover for covering at least a portion of a boat's deck.

12. The combination cruising top and storage cover of claim 11, wherein the first cover portion is pivotally movable independent of the second cover portion and the second cover portion is pivotally movable independent of the first cover portion.

13. The combination cruising top and storage cover of claim 11, wherein the at least first and second cover portions are each mounted to the boat for pivotal movement in relation to each other, and wherein further each of the at least first and second cover portions is pivotally moveable into each of the first, raised and second, lowered configurations thereof.

14. The combination cruising top and storage cover of claim 11, wherein the at least first and second cover portions each comprise a covered framework.

15. The combination cruising top and storage cover of claim 11, wherein each of the at least first and second cover portions comprises a framework including at least two pair of lateral struts, each pair of struts pivotally connected at one end thereof to the boat and at the other end thereof to one of a pair of laterally spaced-apart, horizontally extending frame members interconnected by a plurality of spaced-apart, transverse frame members.

16. The combination cruising top and storage cover of claim 11, wherein the at least first and second cover portions each comprise a framework covered by a covering material which extends between the at least first and second cover portions to define a continuous storage cover when the at least first and second frame portions are in the second, lowered configuration thereof.

17. The combination cruising top and storage cover of claim 11, further comprising means for effecting the powered movement of each of the at least first and second cover portions between the first, raised and second, lowered configurations thereof.

18. The combination cruising top and storage cover of claim 11, wherein in the second, lowered configuration thereof, the at least first and second cover portions define a storage cover for substantially the entire passenger area of a boat's deck between the fore and aft ends thereof.

* * * * *